United States Patent [19]

Smith

[11] Patent Number: 4,624,514

[45] Date of Patent: Nov. 25, 1986

[54] STATION INTERFACE AND PROTECTOR APPARATUS

[75] Inventor: Thomas J. Smith, Bay Shore, N.Y.

[73] Assignee: TII Industries, Inc., Copiague, N.Y.

[21] Appl. No.: 695,360

[22] Filed: Jan. 28, 1985

[51] Int. Cl.[4] ..... H01R 4/66

[52] U.S. Cl. ..... 379/412; 339/147 R; 339/198 R; 339/14 R; 361/119

[58] Field of Search ..... 339/154, 156, 126, 125 R, 339/198 J, 198 R, 147 R, 147 P; 179/98, 178, 179

[56] References Cited

U.S. PATENT DOCUMENTS

| | | | |
|---|---|---|---|
| 3,657,503 | 4/1972 | Smith | 339/198 J |
| 4,213,013 | 7/1980 | Perna et al. | 179/98 |
| 4,303,296 | 12/1981 | Spaulding | 339/147 R |
| 4,438,477 | 3/1984 | Cawley | 179/178 |
| 4,488,008 | 12/1984 | Dellinger et al. | 179/179 |

*Primary Examiner*—Gil Weidenfeld
*Assistant Examiner*—David L. Pirlot
*Attorney, Agent, or Firm*—Sachs & Sachs

[57] ABSTRACT

A station interface and protector apparatus for use on a telephone line pair includes a protector device having terminals connected from each line to a round terminal, via a gas discharged tube and/or a protective air gap and includes an insulated cover which covers the protector device and is provided with a telephone receptacle (jack) to which the incoming telephone line pair is connected. A cable having a plurality of wires therein is terminated on one end with a cooperating telephone line plug disposed within the receptacle with the other end of the cable wires being connected to a plurality of terminals provided in the cover which is additionally adapted to receive the subscribers telephone line pairs. By removing the cable plug from the jack provided in the cover the incoming telephone line may be isolated from the subscribers wiring, thus inserting a known operating telephone into the housing receptacle and operating the telephone will immediately determine if the problem exists in the incoming telephone lines or the subscriber's wiring.

6 Claims, 6 Drawing Figures

STATION INTERFACE AND PROTECTOR APPARATUS

BACKGROUND OF THE INVENTION

1. Field of the Invention

The present invention relates to telephone interface apparatuses and jacks, and more particularly, to a station interface and protector apparatus which permits isolation of subscriber's telephone line wiring from the incoming telephone lines in order to isolate problems appearing on the telephone lines.

2. Discussion of the Relevant Art

With the advent of the breakup of the telephone company as it was formerly known, individual customers are permitted to connect their own independently purchased telephones to the incoming telephone lines. In order to minimize the amount of tampering and/or connections that a customer will make to the lines already installed on their premises, numerous systems and devices have been invented to permit connection by the consumer of an owner purchased telephone which has disposed on the distal end of its line cord a modular plug. This modular plug is adapted to be received into a modular jack or receptacle and thus, the normal terminal block installed by the telephone company is required to have an adapter connected thereon capable of receiving telephone line cord plug. Typical of these converters is the apparatus disclosed in U.S. Pat. No. 4,118,505 issued to R. J. O'Connor which provides for a simple conversion from a conventional terminal block to a modular type receptacle or jack.

Another type of device utilized with these plug-in receptacles is disclosed in U.S. Pat. No. 4,047,787 issued to B. W. Gumb, et al on Sept. 13, 1977 which permits a singular modular plug similar to that found on the distal end of a telephone line cord to be coupled to a housing in which a plurality of receptacles disposed in parallel are incorporated. These additional receptacles permit the use of several pieces of equipment all being in parallel with the telephone line into which the line plug has been inserted.

Yet another type of apparatus disclosed in U.S. Pat. No. 4,103,985 issued to R. F. Krolak on Aug. 1, 1978 utilizes a plurality of telephone modular receptacles and a in-line multi-terminal connector permitting the interconnection of telephone equipment and telephone signal equipment.

None of these devices relate to an apparatus which is to be connected at the point where the incoming telephone line pair joins the subscriber's in house wiring where the junction is usually made on an apparatus provided with terminals therefor and additionally provides for overvoltage or surge protection. Now that the subscriber or customer is able to connect his own equipment to the incoming telephone lines it is advantageous to be able to isolate the incoming telephone lines provided by the telephone company from the customer's in house wiring so that if a problem should arise on the telephone line one could isolate the problem appearing on the input telephone lines from a problem caused by improper wiring in the subscriber's residence. The incoming telephone lines may be readily disconnected from the subscriber's wiring by removal of a modular cable plug provided in the apparatus described herein when removed from its receptacle. The apparatus provides direct access to the incoming telephone lines and by placing a known operating telephone line cord jack into this receptacle it can be determined that the incoming telephone lines are operating properly, thus eliminating them as being the source of the problem.

Therefore, it is an object of the present invention to provide a device that can be readily installed by a telephone subscriber that permits separation of the incoming telephone lines from the subscriber's phone wiring.

It is another object of the present invention to provide a replacement housing that may readily be connected to the existing base and is an overvoltage protection device that provides terminals for receiving the subscriber's in house wiring yet maintains continuity with the incoming telephone lines.

It is yet another object of the present invention to provide a station interface and protector apparatus that is capable of separating the incoming telephone lines from the subscriber's in house wiring and is capable of handling more than a single input telephone line pair.

It is still yet another object of the present invention to provide a reliable inexpensive, weather protected housing suitable to replace the housing presently utilized by the telephone company to connect the subscriber's in house wiring with the incoming telephone lines and yet provides a simple means for isolating the input telephone lines from the subscriber's in house telephone wiring.

SUMMARY OF THE INVENTION

A station interface and protector apparatus for use on a telephone line pair connected to a subscriber's telephone line pair, according to the principles of the present invention, comprises in combination; a protector device which includes a pair of terminals adapted to receive thereon an incoming telephone line pair and a ground terminal adapted to receive a ground wire thereon. An overvoltage protection device is connected between each of the line terminals and the ground terminal and is disposed on an insulated housing which may be mounted to a surface. A cover, to cover the overvoltage protector device, includes a receptacle or jack adapted to receive a modular plug disposed on the distal end of a plug-in telephone line cord and has at least two terminals. The receptacle terminals are electrically connected to the line terminals. At least two station terminals are disposed in the cover and are adapted to receive the subscriber's telephone line pair thereon. A cable connection having a plurality of wires therein has one end connected to each of the station terminals and the other distal ends of the wires are terminated in a modular plug similar to the plug disposed on the distal end of the plug-in telephone line cord so that either of the plugs may be placed in a housing receptacle to continue to the incoming telephone line pair. The cover additionally includes a captured rotating nut which functions to hold the cover onto the protecting device by means of being threaded on to the upwardly extending threaded ground terminal.

The foregoing and other objects and advantages will appear from the description to follow. In the description reference is made to the accompanying drawing which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 2:
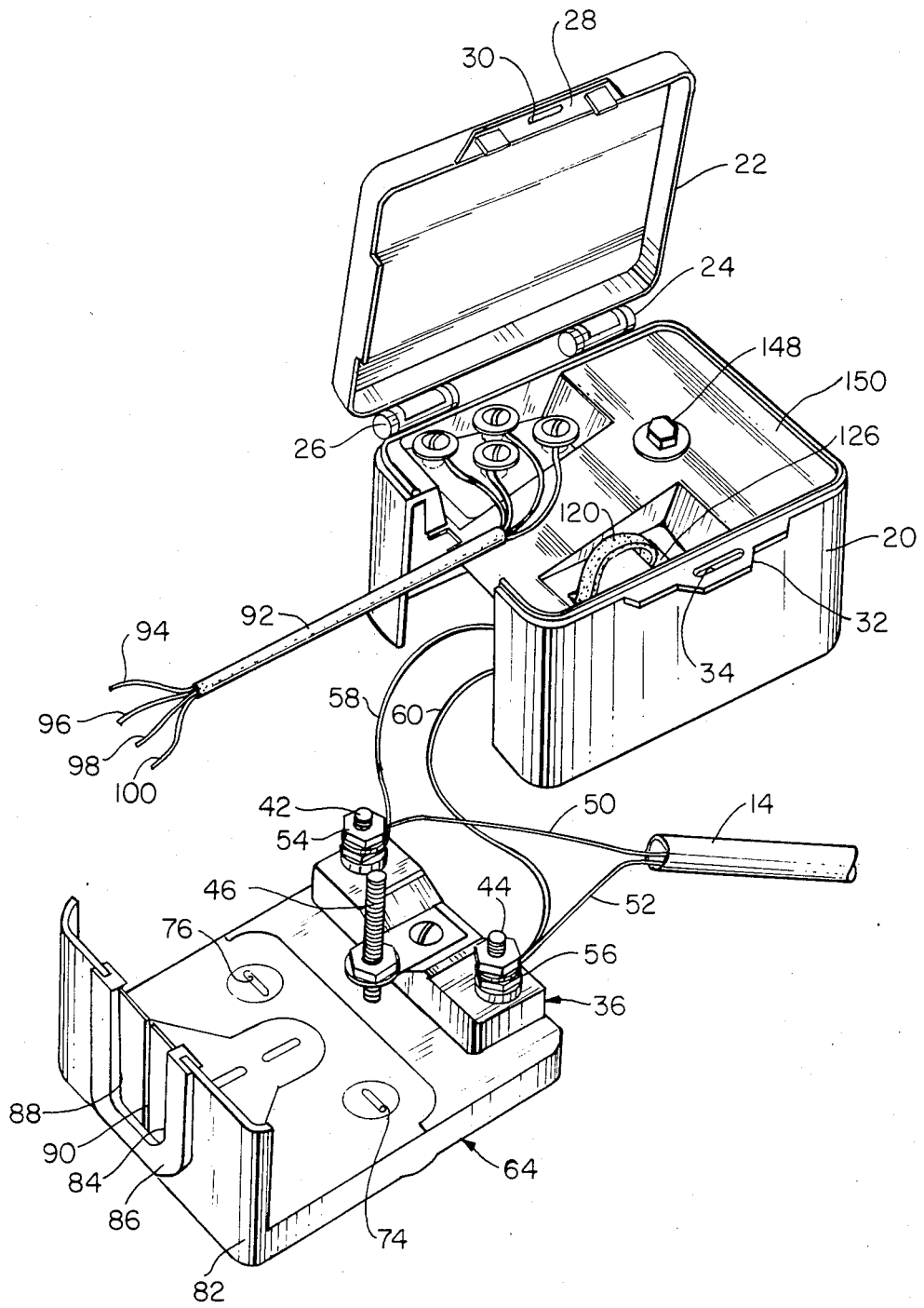
FIG. 2 is an exploded isometric view of the station interface and protector shown in FIG. 1 with the overvoltage protector device exposed.

Referring now to the Figures, and in particular to FIGS. 1 through 4, there is shown (FIG. 1) a prospective view of a station interface and protector apparatus 10 according to the principles of the instant invention, fixed to a vertical wall 12 which is a subscriber's residence. The telephone company provides at least one pair of input wires in a cable 14 and may include a second cable 16 for additional pair of telephone wires which are brought from the telephone pole 18 to the subscriber's residence. The station interface and protector apparatus 10 includes a cover 20 and cap 22 which is hingedly attached by means of a pair of hinges 24 and 26 to the cover 20. An extending lip portion 28 having an aperture 30 therein, provides a means for locking the cap and cover portion, since the lip portion cooperates with an extending lip portion 32 and aperture 34 provided on the cover 20 (FIG. 2).

An overvoltage protection device 36 may include a pair of gas tubes 38 and 40 (see FIG. 6) or a single device having the same capabilities, embedded in an epoxy material which is electrically insulated and hides the tubes from view. The overvoltage protection device 36 includes a pair of line terminals 42 and 44 and a ground terminal 46. Ground terminal 46 includes an upwardly extended threaded stud 48 whose function will be explained hereinafter. Line terminals 42 and 44 also include threaded studs and are adapted to receive the input telephone line wires 50 and 52 provided in cable 14 with the aid of nuts 54 and 56, respectively, in a conventional manner and also receive wires 58 and 60 which are connected to the rear end of modular jack or receptacle 62. Modular jack or receptacle 62 is generally of the type disclosed in U.S. Pat. No. 3,850,497.

Figure 1:
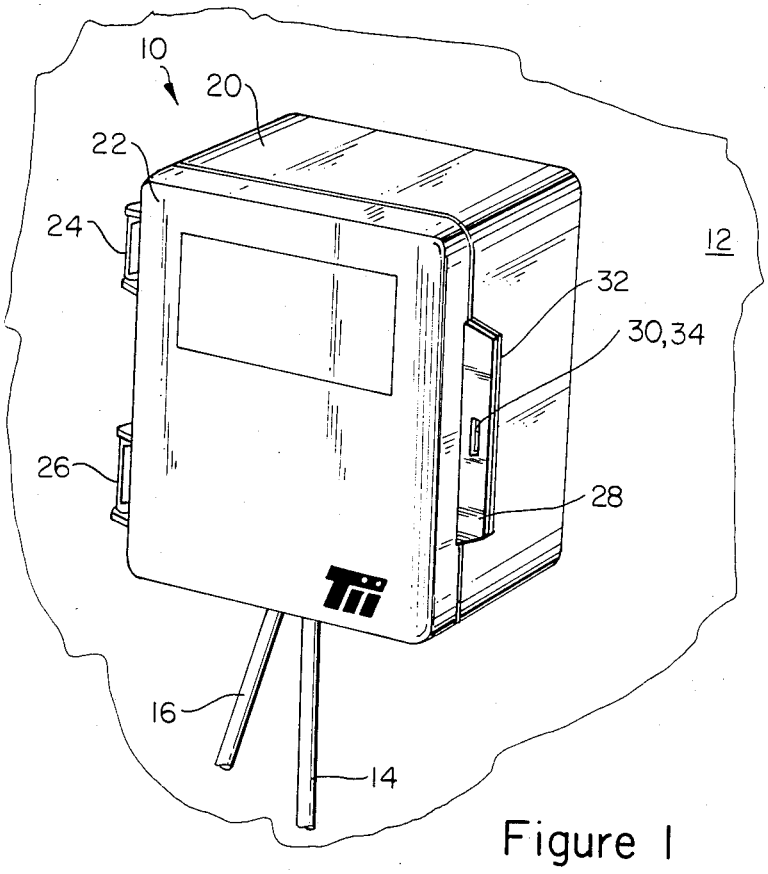
FIG. 1 is a pictorial representation of a station interface and protector apparatus, according to the principles of the present invention.
Figure 5:
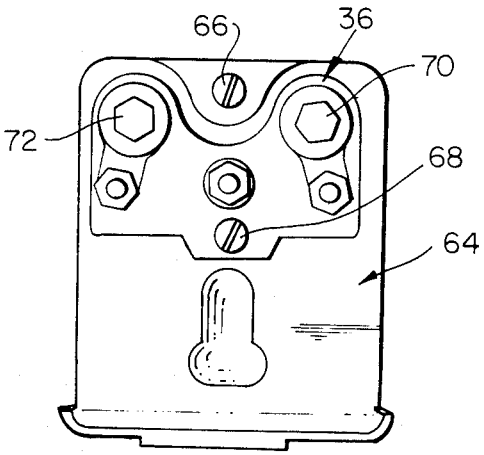
FIG. 5 is an alternative embodiment of the overvoltage protection device.

Overvoltage protection device 36 may be fabricated in one integral piece to include base portion 64 or base portion 64 may be fabricated as a separate component with the overvoltage protection device 36 affixed thereto in a conventional manner by means of screws 66 and 68 as shown in FIG. 5. The overvoltage protection device 36 shown in FIG. 5 is of a different type than that shown in FIGS. 2 through 4 since the gas tubes used to protect the telephone lines may be removed and replaced by the removal of cap nuts 70 and 72.

Base portion 64 is provided with apertures 74 and 76 (FIG. 3) which is adapted to receive screws 78 and 80, respectively, so that the mounting base portion 64 may be affixed to a flat surface. Base portion 64 may also be provided with a vertically upstanding wall 82 which is provided with an opening 84 that is provided with a U-shaped channel member 86 of insulating material which as inserted therein resilient member 88 having a slit 90 provided therein. Resilient member 88 is adapted to receive the input line cable wires 50 and 52 from cable 14 therethrough as well as cable wire 92 which includes wires 94, 96, 98 and 100 that are connected to terminals 102, 104, 106 and 108, respectively, and are labeled red (R), green (G), yellow (Y), and black (B), respectively, for the convenience of the subscriber. The rear end of terminals 94, 96, 98 and 100 are connected, via wires 110, 112, 114 and 116, respectively, to one end 118 of cable 120 which is retained in cover 20 by a conventional clamping device 122. The other distal end 124 of cable 120 is terminated in a modular plug 126 which is adapted to mate and cooperate with receptacle or jack 62 and provide a continuous electrically conducted path from the wires 50 and 52 of input line cable 14 to receptacle 62 and through plug 126 to terminals 102, 104, 106 and 108, respectively.

Figure 3:
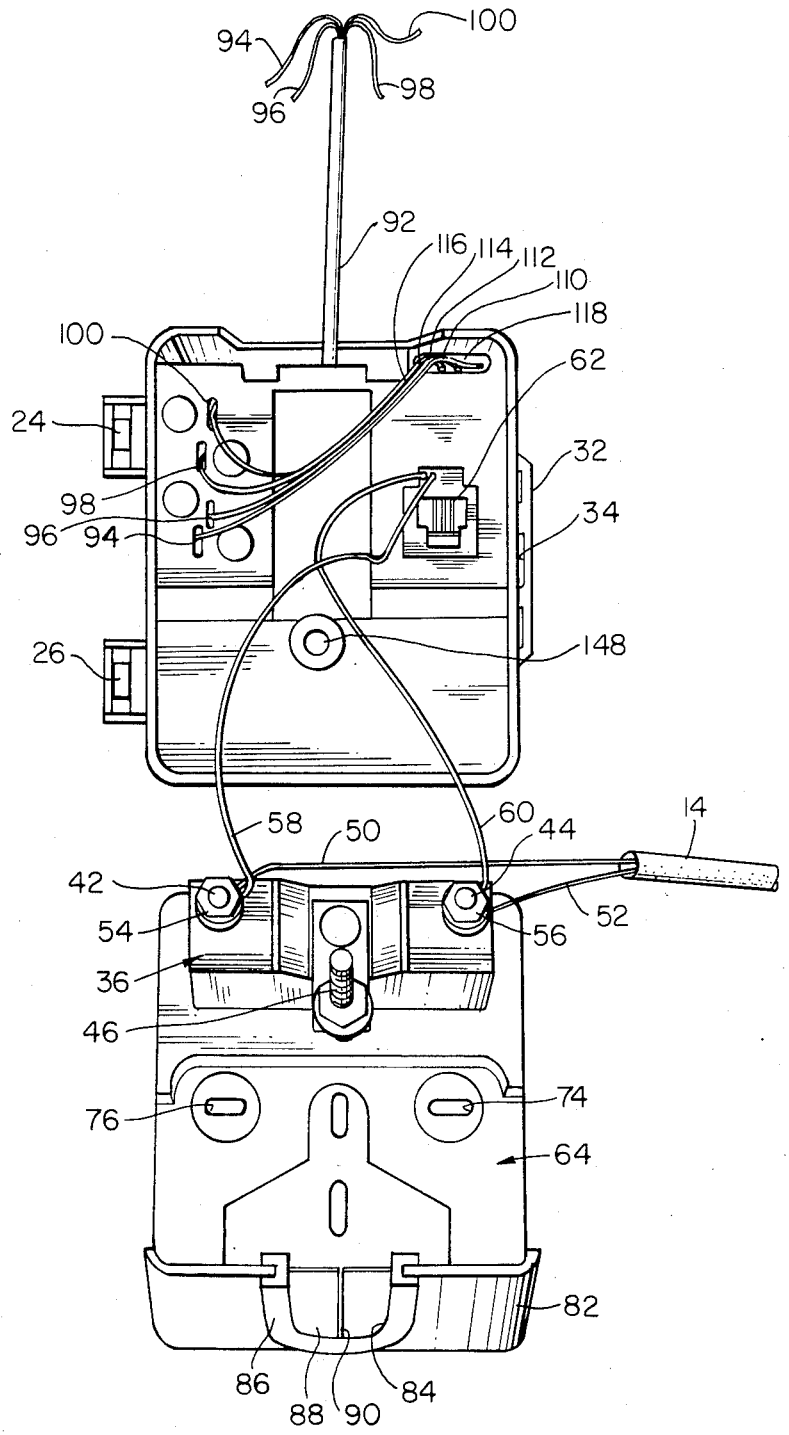
FIG. 3 is a pictorial representation of the station interface and protector apparatus shown in FIG. 2 with the underside of the cover being exposed to view.
Figure 4:
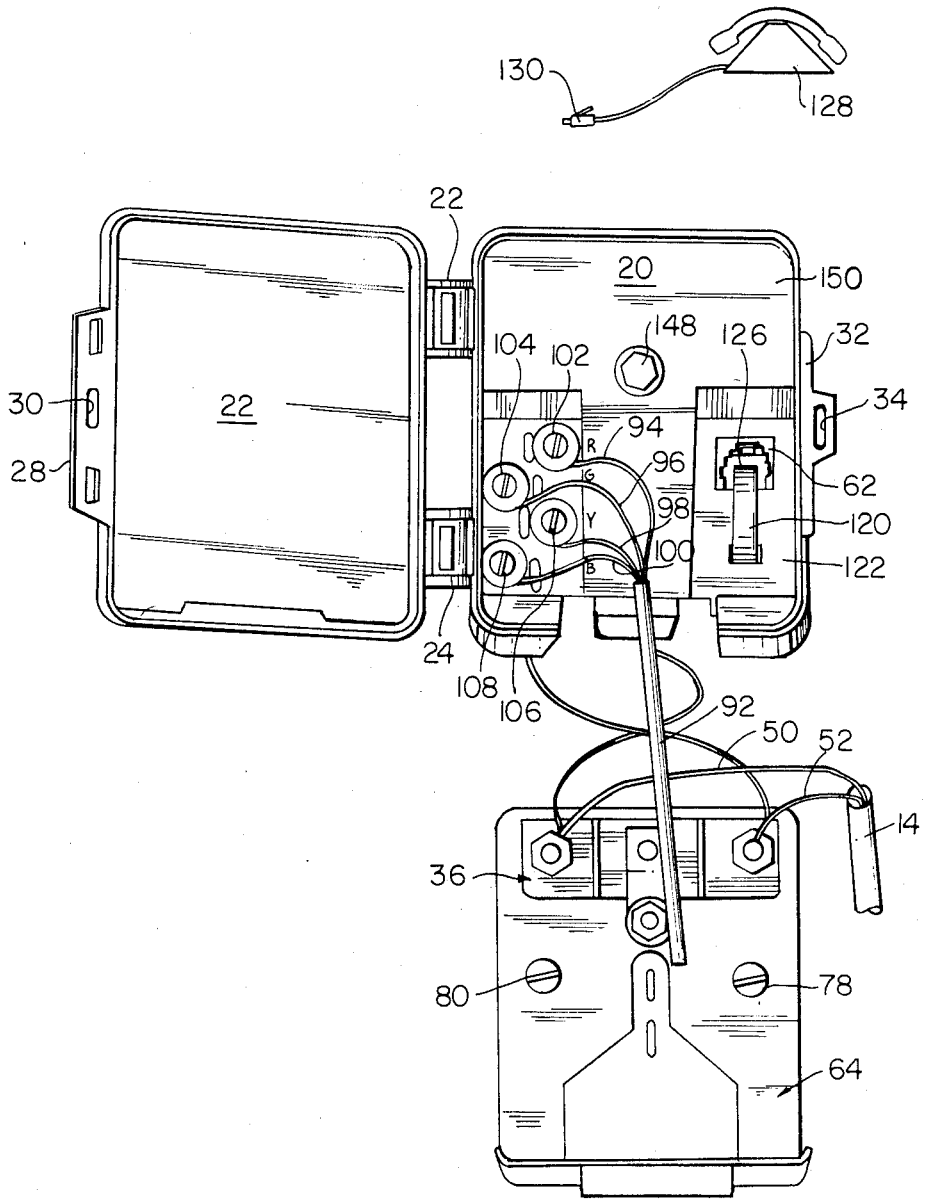
FIG. 4 is an exploded top view of the station interface and protector apparatus shown in FIG. 1 with a plug-in modular telephone available for use therewith.
Figure 6:
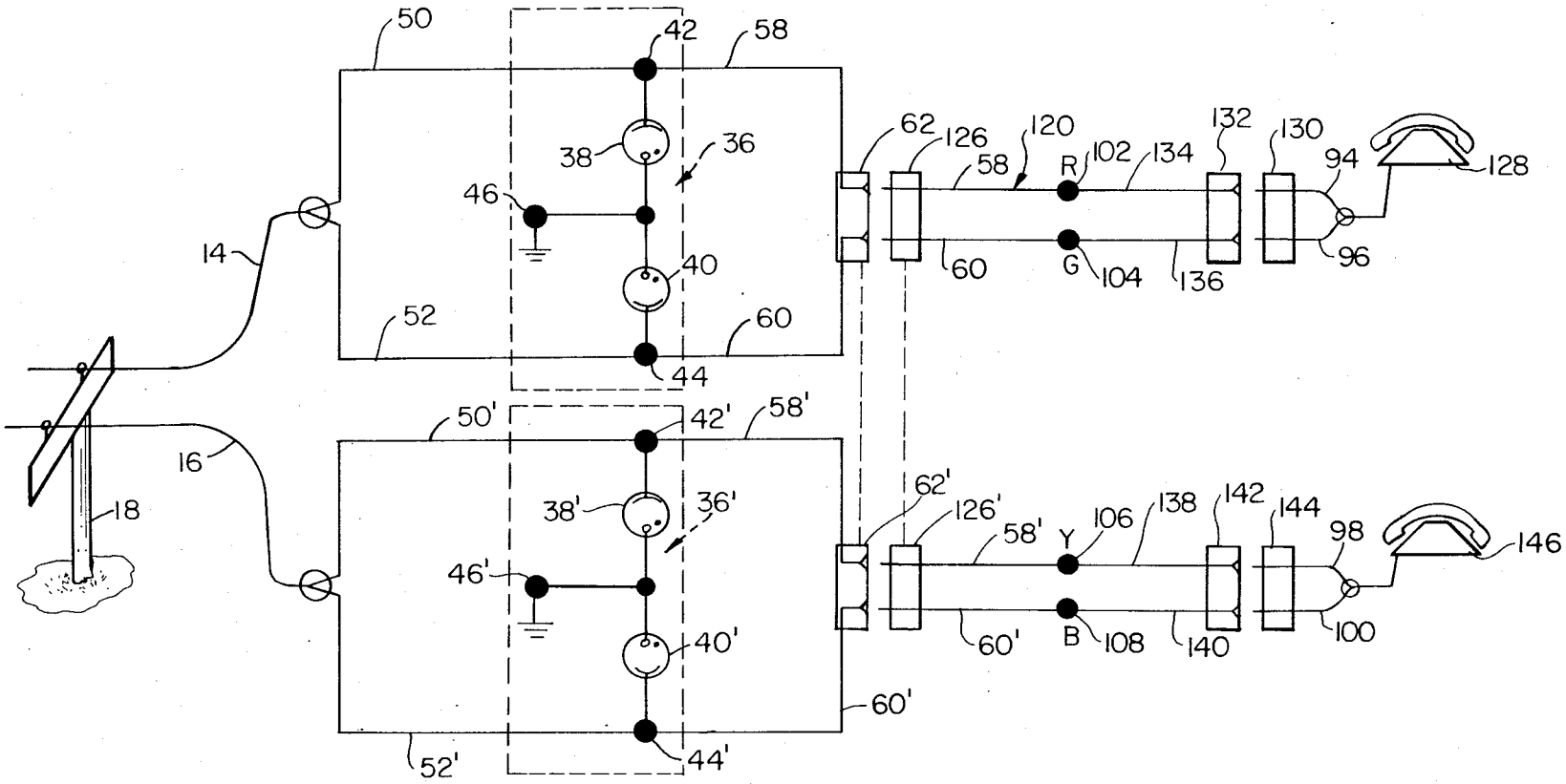
FIG. 6 is a schematic circuit diagram of the station interface and protector apparatus of the instant invention.

Although one overvoltage protection device 36 is shown in FIGS. 2 through 4 it is to be clearly understood that the base portion 64 is suitable for having two such devices affixed thereon or as an integral part thereof and they may be wired as shown specifically in FIG. 6 with the second overvoltage protection device and its associated wiring being indicated by the primed numbers shown thereon.

Thus, jack 126 and receptacle 62, shown as having two terminals therein being wired, may include four wired terminals and plug 126 inserted in receptacle 62 may also have four terminals wired as shown in FIG. 6 with two line pairs 14 and 16 being incorporated in a single plug wherein a single instrument can selectively operate on either of the two lines. Alternatively, single individual telephone instruments 128 and 146 having modular plugs 130 and 144 affixed on the distal ends of the associated line cords may be connected, via mounted room jacks or receptacles 132 and 142 and wires 134 and 136; and 138 and 140 in terminals 102 and 104; and 106 and 108, respectively, thereby completing the circuit from telephone instruments 128 and 146 to terminals 102, 104, 106 and 108 to input line cables 14 and 16.

Of course, multiple telephone instruments may be utilized on the same line pair by connecting them in parallel with terminals 102 and 104.

The cover 20 is also provided with a flared nylon nut 148 which is captured by the top surface 150 of the cover 20 and is adapted to receive ground terminal 46 therein. Thus, when cover 20 is placed upon base 64 nut 148 may be used to retain cover 20 thereon and when cap 22 is closed down on cover 20 the station interface protector apparatus 10 is closed off from the external elements.

In operation, when a telephone company updates a subscriber's telephone equipment to provide for telephone instruments having modular plugs thereon, they may readily update his equipment to include the station interface and protector apparatus 10 as disclosed herein by removing the cover presently protecting the overvoltage protection device appearing at the termination of the incoming telephone lines. If the overvoltage protection device is not provided with a base portion 64 as shown herein, they may mount the base portion to a nearby surface and mount the overvoltage protection device onto the base portion as shown in FIG. 4. The telephone company will then cut the telephone wires connected to terminals 42 and 44, or remove them in a conventional manner if they are provided with conventional spade lugs, and replace the two wires removed from terminals 42 and 44 on the overvoltage protection device with the two wires 58 and 60 extending from the cover 20 of the instant invention. The two wires thus removed from the overvoltage protection device are then connected to terminals 102 and 104 on cover 20 maintaining the proper color arrangement or if they are color coded different than indicated on the cover 20 terminals 102 and 104 will be utilized. Thus, with plug 126 inserted into receptacle 62 continuity will be maintained from the input telephone lines to terminals 102 and 104. Jacks wired throughout the house may then be brought to terminals 102 and 104 and if the color code is maintained they may also be placed on terminals 106 and 108 for additional connections or a second input line pair.

If multiple telephones (extensions) are to be connected on the same line pair then they are connected to terminals 102 and 104 maintaining the proper color code arrangement. A second input line pair may be connected to terminals 106 and 108 in the same manner and wired to independent telephone jacks. The independent jacks may receive entirely independent input telephone lines from a second phone cable brought into the residence by the telephone company as indicated in FIG. 6.

Should the subscriber experience some difficulty on a particular telephone line it is only necessary that a known operating telephone be utilized and insert it into receptacle 62 after removing plug 126 therefrom. By operating the telephone one can then determine whether the problem arising has been introduced by the internal house wiring or the incoming telephone line, since if the telephone operates correctly while plugged into receptacle 62 the telephone input lines are in good working order and the problem must have been generated by the wiring within the residence. If improper operation occurs the problem is in the input telephone line and the telephone company must be contacted to locate the problem in the incoming line pair.

Hereinbefore has been disclosed an inexpensive, simply installed, station interface and protector apparatus which is capable of providing isolation from the input telephone lines to the subscriber's residential telephone lines thereby providing a convenient, easily usable, means for isolating the input lines from the residence lines.

It will be understood that various changes in the details, materials, arrangement of parts and operating conditions which have been herein described and illustrated in order to explain the nature of the invention may be made by those skilled in the art within the principles and scope of the invention.

Having thus set forth the nature of the invention, what is claimed is:

1. A station interface and protector apparatus for use on an incoming telephone line pair connected to a subscriber's telephone line pair, comprises in combination:

A. protector means including;
- (i) a pair of terminals adapted to receive thereon said incoming telephone line pair,
- (ii) a ground terminal adapted to receive thereon a ground wire,
- (iii) an overvoltage protection device connected between each said line terminals and said ground terminal, and
- (iv) insulated base means having means for mounting to a surface and adapted to receive said overvoltage protection device said ground terminal being affixed in said base means; and B. cover means for covering said base means and said protector means, said cover means including;
- (i) receptacle means of the type adapted to receive a plug disposed on the distal end of a plug-in telephone line cord and having at least two terminals,
- (ii) connection means for electrically connecting said receptacle terminals to said line terminals,
- (iii) at least two station terminals disposed in said cover means, said station terminals being adapted to receive said subscriber telephone line pair,
- (iv) cable connection means having a plurality of wires therein, one end of each of said wires being connected to each of said station terminals, the other distal ends of said wires being terminated in a plug similar to said plug disposed on the distal end of said plug-in telephone line cord so that when either of said plugs is placed in said receptacle said telephone line pair is continued,
- (v) attaching means cooperating with said ground terminal for removably attaching said cover means to said protector means and completely covering said base means,
- (vi) hinge means disposed on one edge of said cover means; and C. cap means having means for cooperating with said cover hinge means for covering said complete cover.

2. A station interface and protector apparatus according to claim 1 wherein said cap means further includes:
- (i) locking means adapted to cooperate with cooperating locking means provided on said cover means.

3. A station interface and protector apparatus according to claim 1 wherein said attaching means includes an upwardly extending threaded ground terminal stud and said cover means is provided with retained nut means adapted to cooperate with said threaded ground stud for retaining said cover means and said cap means on said base means.

4. A station interface and protector apparatus according to claim 1 wherein said insulated base means and said voltage protection device is a single integral component.

5. In a station interface and protector apparatus for use on a telephone line pair connected to a subscriber's telephone line pair, which has disposed thereacross a protection device disposed in an insulating housing connected between the terminals of each said line pair and a ground terminal, the improvement which in combination comprises:

(A) cover means for covering said protection device, said cover means including;

(i) receptacle means of the type adapted to receive a plug disposed on the distal end of a plug-in telephone line cord and having at least two terminals, (ii) connection means for electrically connecting said receptacle terminals to said line terminals, (iii) at least two station terminals disposed in said cover means, said station terminals being adapted to receive said subscriber telephone line pair, (iv) cable connection means having a plurality of wires therein, one end of each of said wires being connected to each of said station terminals, the other distal ends of said wires being terminated in a plug similar to said plug disposed on the distal end of said plug-in telephone line cord so that when either of said plugs is placed in said receptacle said telephone line pair is continued, (v) attaching means cooperating with said ground terminal for removably attaching said cover means to said protector means and completely covering said base means, (vi) hinge means disposed on one edge of said cover means; and (B) cap means having means for cooperating with said cover hinge means for covering said complete cover.

6. A station interface and protector apparatus according to claim 5 wherein said cap means further includes:

(i) locking means adapted to cooperate with cooperating locking means provided on said cover means.

* * * * *

UNITED STATES PATENT AND TRADEMARK OFFICE

CERTIFICATE OF CORRECTION

PATENT NO. : 4,624,514

DATED : November 25, 1986

INVENTOR(S) : Thomas J. Smith

It is certified that error appears in the above-identified patent and that said Letters Patent is hereby corrected as shown below: Title page:

In The Abstract:

Line 3, delete "round" and insert therefor --ground--.

In the Specification:

Column 1, line 28, after "receiving" insert therefor --a--.

Column 2, line 39, delete "housing" and insert therefor --base--.

Column 3, lines 31 through 32, delete "prospective" and insert therefor --perspective--.

Column 4, line 20, delete "end of terminals" and insert therefor --ends--; and after the numeral "100" insert therefor --of terminals 102, 104, 106 and 108--.

Column 4, line 27, delete "conducted" and insert therefor --conductive--.

In the Claims:

Claim 1, column 6, lines 44 and 45, delete "covering said complete cover" and insert therefor --completely covering said cover means--.

UNITED STATES PATENT AND TRADEMARK OFFICE

CERTIFICATE OF CORRECTION

PATENT NO. : 4,624,514

DATED : November 25, 1986

INVENTOR(S) : Thomas J. Smith

It is certified that error appears in the above-identified patent and that said Letters Patent is hereby corrected as shown below:

Claim 5, column 8, lines 10 and 11, delete "covering said complete cover" and insert therefor --completely covering said cover means--.

Signed and Sealed this

Fifth Day of April, 1988

*Attest:*

*Attesting Officer*

DONALD J. QUIGG

*Commissioner of Patents and Trademarks*